US007661607B1

(12) United States Patent
Bowden

(10) Patent No.: US 7,661,607 B1
(45) Date of Patent: Feb. 16, 2010

(54) SHOWERHEAD CONTROLLER ASSEMBLY

(76) Inventor: Gladys P. Bowden, 13311 Coluccio, Venice, FL (US) 34293

( * ) Notice: Subject to any disclaimer, the term of this patent is extended or adjusted under 35 U.S.C. 154(b) by 0 days.

(21) Appl. No.: 11/900,621

(22) Filed: Sep. 11, 2007

(51) Int. Cl.
*B05B 7/26* (2006.01)

(52) U.S. Cl. ..... 239/310; 239/318; 239/407; 239/581.1; 137/268

(58) Field of Classification Search ..... 239/310, 239/315–318, 282, 407, 581.1; 137/268
See application file for complete search history.

(56) References Cited

U.S. PATENT DOCUMENTS 3,764,074 A * 10/1973 James ..... 239/318
4,193,520 A * 3/1980 Duffield ..... 239/310
4,200,206 A * 4/1980 Chase et al. ..... 239/317
4,281,796 A * 8/1981 Fugent et al. ..... 239/310
5,356,076 A * 10/1994 Bishop ..... 239/581.1
6,647,566 B1 * 11/2003 Wang ..... 239/310

* cited by examiner

*Primary Examiner*—Steven J Ganey
(74) *Attorney, Agent, or Firm*—Ancel W. Lewis, Jr.

(57) ABSTRACT

A showerhead in which the basic assembly attaches to a water supply pipe that controls and directs the mixing of solutes of various kinds, such as shampoo, moisturizers, liquid soaps or perfumed water and water itself. These are mixed and dispensed with incoming water that passes into, through and out off the controller assembly. These have a solute containing reservoir or reservoirs with different solutes that easily attach or detach for refilling. When adjusted to go to the showerhead or alternately to the bathtub for both showering and bathing, different amounts of solutes may be added to a reservoir to obtain the amounts most desirable. With such a system the water-solute mixture is able to cover the entire body. By selecting mixtures or adding more or less solutes to the reservoir, the skin is treated in such a way that it becomes softer and not itchy.

3 Claims, 9 Drawing Sheets

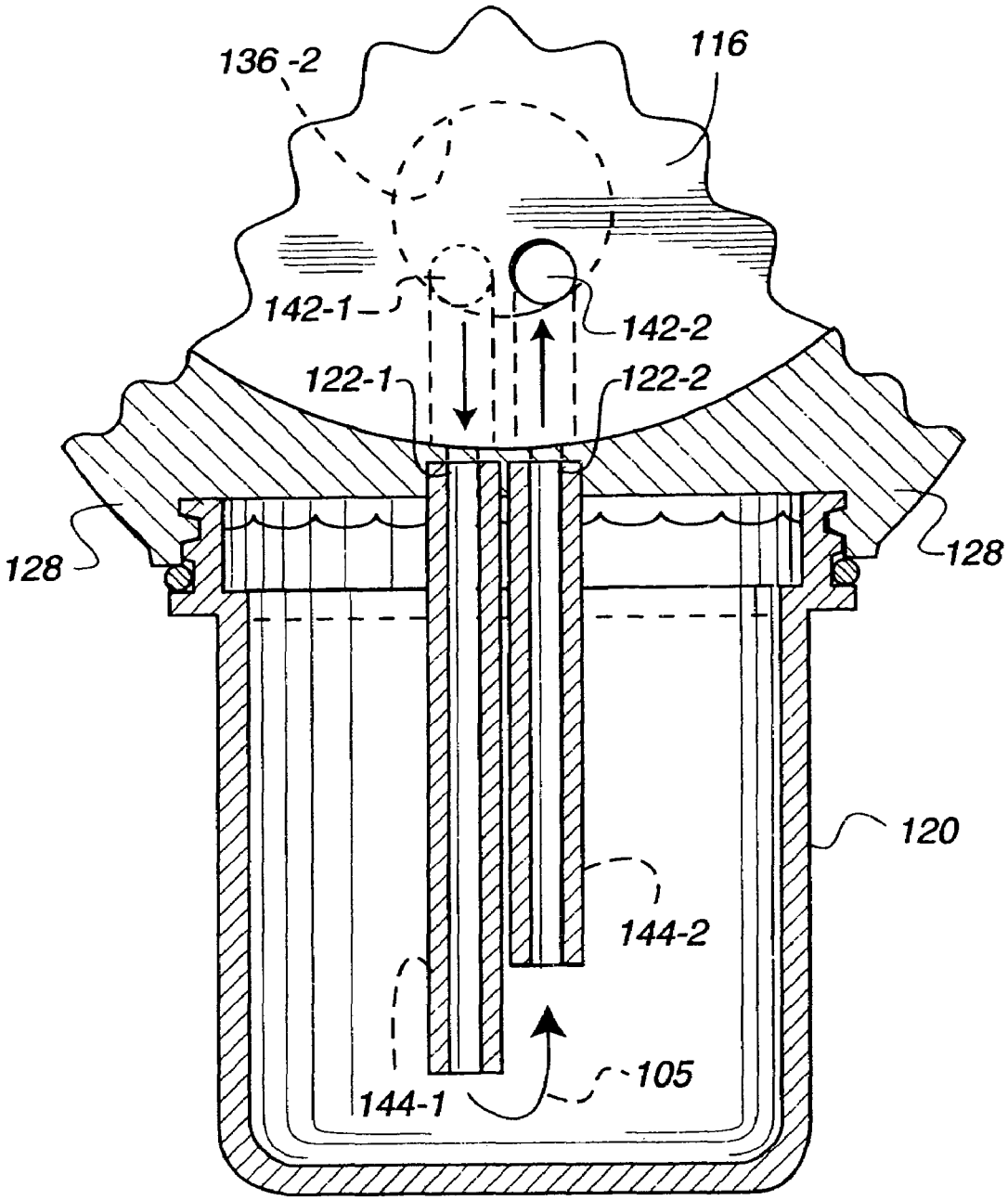
Fig. 9-a

SHOWERHEAD CONTROLLER ASSEMBLY

BACKGROUND OF THE INVENTION

1. Field of the Invention

This application relates to controller assemblies for showering that mix water with solutes of various kinds as they pass through the controller assembly, whereas shampoo, moisturizers, liquid soaps or even perfumed water may be dispensed with the shower stream.

2. Prior Art

In the past there have been numerous unsuccessful attempts to provide a greater range of functions for showers as in many attempts at developing controller assemblies that would satisfy the requirements of such an active and crowded field of art. Some of the following desirable features in showerheads or showerhead systems that are needed are to be able to flush out and clean with water the inner mechanism, or to be able to shut off the liquid flow at either upper and lower controls, run bath water alone or with the shower and to be able to extend the capabilities of a range of minute or more robust adjustments for the water, water-solute, or other useful mixtures being dispensed.

SUMMARY OF THE INVENTION

A controller assembly which attaches to a water supply pipe and a reservoir that dispenses from it, upon its attachment and adjustment, useful solutes mixed with water that when adjusted to go to the showerhead or alternately to the bathtub for convenience when showering and bathing. Different amounts of solutes may be added to the reservoir to obtain the amounts most desirable. With such a system the water-solute mixture is able to cover the entire body. By selecting mixtures or adding more or less solutes to the reservoir, skin duly treated is softer and not itchy.

Manufactured showerheads have not succeeded in offering a controller assembly that accomplishes most of these needs as described. This is further evidenced by the numerous patents that have been issued in this busy field; the actual controller assemblies are yet to satisfactorily achieve many of the objectives that will stimulate purchasing interest in the commercial market place. Some embodiments utilize shower systems which simultaneously contain multiple solute containers from which the solutes are selectively dispensed. As an example U.S. Pat. No. 6,550,695 B1 to Cecillo Trent, this showerhead dispenser has a bulbous head with a plurality of selectable chambers for dispensing solutes. Chambers such as these are capable of holding relatively small amounts of different kinds of solutes such as lotions, shampoos or liquid soaps, which are finally mixed with water upon dispensing. Trent does not teach a visually convenient and easily selectable way to utilize particular solute-water mixtures. Also the terminal spray from the Trent invention is not pivotally adjustable of which even some of the oldest showers are capable. Therefore, there is a ready market for a useful multiple purpose showerhead that can be constructed by usual manufacturing procedures. Also desirable, are the abilities to dispense various solute water mixtures which can be adjusted to change from mixed solute to a water only flushing mode that has the pivoting abilities of a typical showerhead that does not requiring special external fixtures to mount the showerhead in a shower stall and that has add-on solute containers that are easily attached, or removed one at a time, with the potential of using as many solutes of different kinds as the user desires. This invention relates to shower controller assemblies that mix and dispenses water and solutes for uses including showering, shampooing, moisturizing and rinsing and more particularly to a controller assembly in which a rotatable disk contains integral apertures through which the flow of liquid is controlled for the accomplishment of the above stated purposes.

The controller assembly controls the flow of water from a water source and solutes from an easily removable and attachable reservoir that is regulated by going through a controller assembly controlled easily by hand positioning of the mixing controller disk, regulating both the flow of water and the solutes passing through apertures in the disk.

By glimpsing the imprinting on the mixing controller disk, as it is being positioned, one knows what will be the spraying characteristics of the shower that is activated contemporaneously as it is being adjusted.

DETAILED DESCRIPTION OF THE PREFERRED EMBODIMENTS

Figure 1:
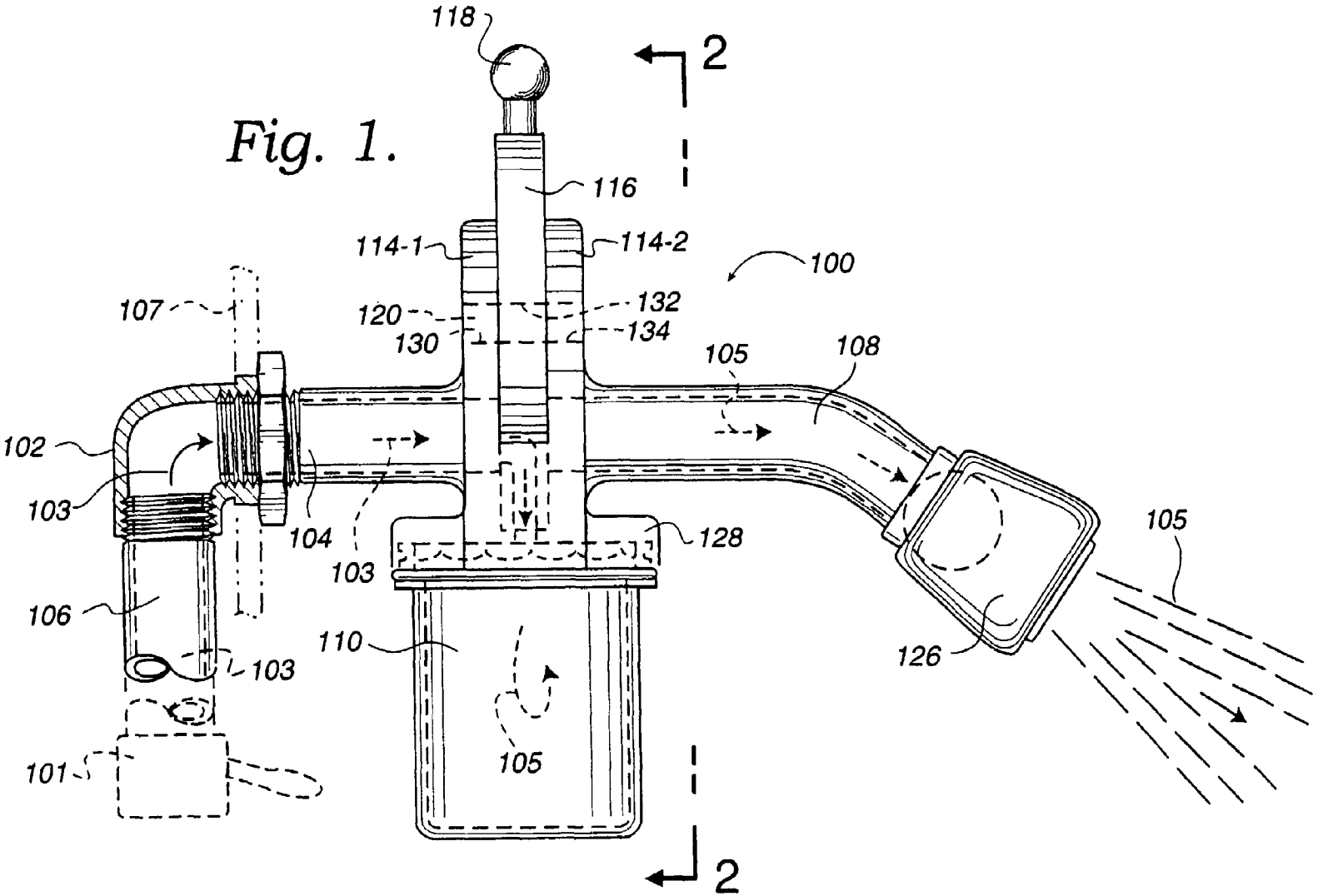
FIG. 1 is a side elevation of the showerhead assembly.
Figure 2:
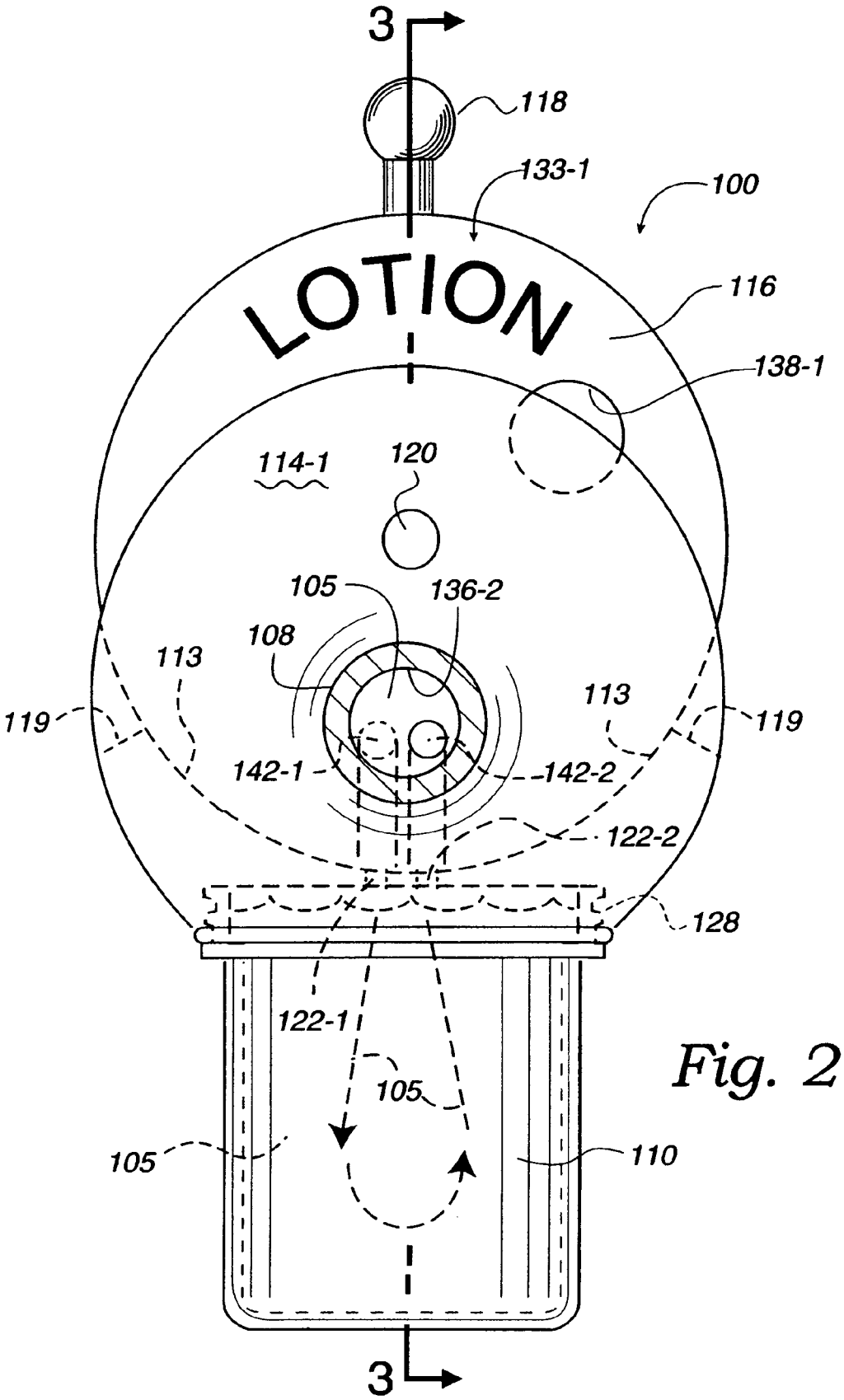
FIG. 2 is a front elevation along the line 2-2 of FIG. 1 of the showerhead assembly in lotion position, showing the exit pipe in a cutaway view.

Referring now to the drawings, the lines 2-2 of FIG. 1 indicate a front view partial section of the controller assembly of FIG. 2. At the shower stall wall side direction from the controller assembly, there is a 90° pipe connector 102. The down pointing end of the pipe connector 102 is vertically positioned behind the shower stall wall and its uppermost horizontal end is secured to an upper water supply pipe 104 and a vertical inlet pipe 106 connects to the 90° pipe connector, being joined by machined threads, or other suitable attaching means at the wall where the horizontal part of the 90° pipe connector 102 extends through. An outlet pipe 108 extends from the controller assembly with about ⅔ of it length horizontal before bending downwardly and terminating at the showerhead 126, where solutes exit in most cases, as a mixed solute spray 105, or rinse water 103, depending on the adjustments manually set for the shower. For mixing and refilling with solutes there is a removable and easily reattachable reservoir 110 connected to the bottom of the controller assembly 100. There are lower controls 101, (indicated by dashed lines) that are connected to the vertical pipe 106 where water may be turned on, initiating a flow upward, or may be turned off stopping the upward flow entirely. The shower and bath tub drain may also be opened or closed at the lower controls 101. These are conventional controls that may be purchased from a plumbing supply store.

For convenience to purchasers, this showering and bath tub system 101 could be offered in kit form by just adding some already manufactured components. Referring to FIG. 2, which is a partial cutaway view of the outlet 108 of FIG. 1, the controller assembly 100 is machined or utilizes other suitable means, such as precision casting, to form an arcuate grove 113, in the controller assembly 100. The groove 113 cradles the disk 116 which adjusts the liquid flow conditions of the controller assembly by being manually rotated around a horizontally positioned pin 120. A hand knob 118, suitably attached at the perimeter of the disk 116 makes it easier for adjustments to be made to obtain desired pipe liquid flow or spray conditions. And as can be seen, an imprinted "LOTION" 133 faces the side within the view of any person using the controller assembly for showering. A mixture of solutes would be traveling through the reservoir (110) when suitably aligned. In order for this to happen, particular apertures are lined-up by hand, adjustment of the disk 116, Aperture 142-1, is lined-up with aperture 122-1 and aperture 142-2 is lined-up with aperture 122-2.

The hand knob 118 and consequently the disk 116 may have a maximal rotation of about 240°, but the rotation could be more or less depending on how the positions are set for a pair of stops 119, one stop for each side of the controller assembly 100.

Figure 3:
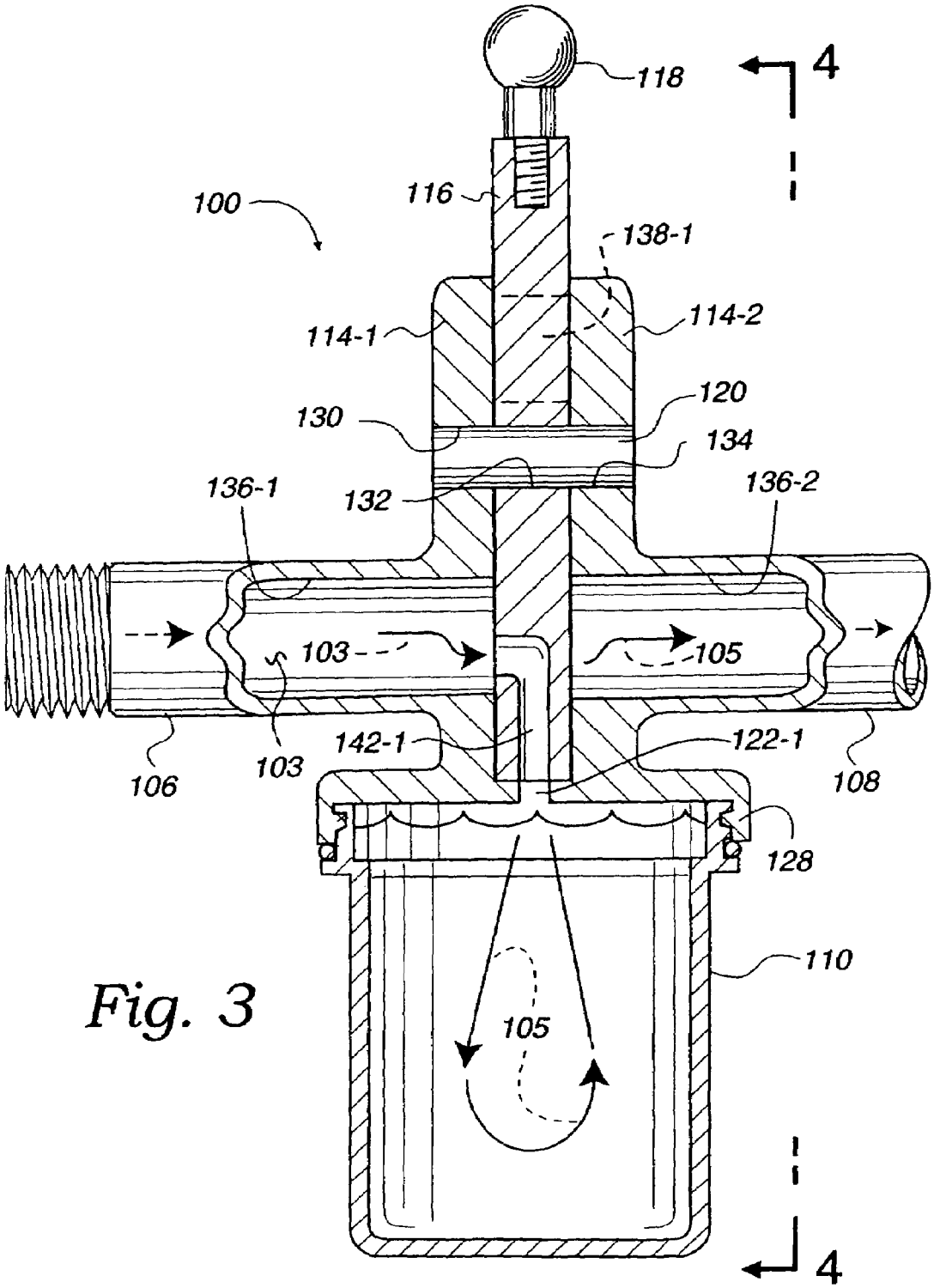
FIG. 3 is a side elevation, partially cutaway, of the showerhead assembly along the line 3-3 of FIG. 2.
Figure 4:
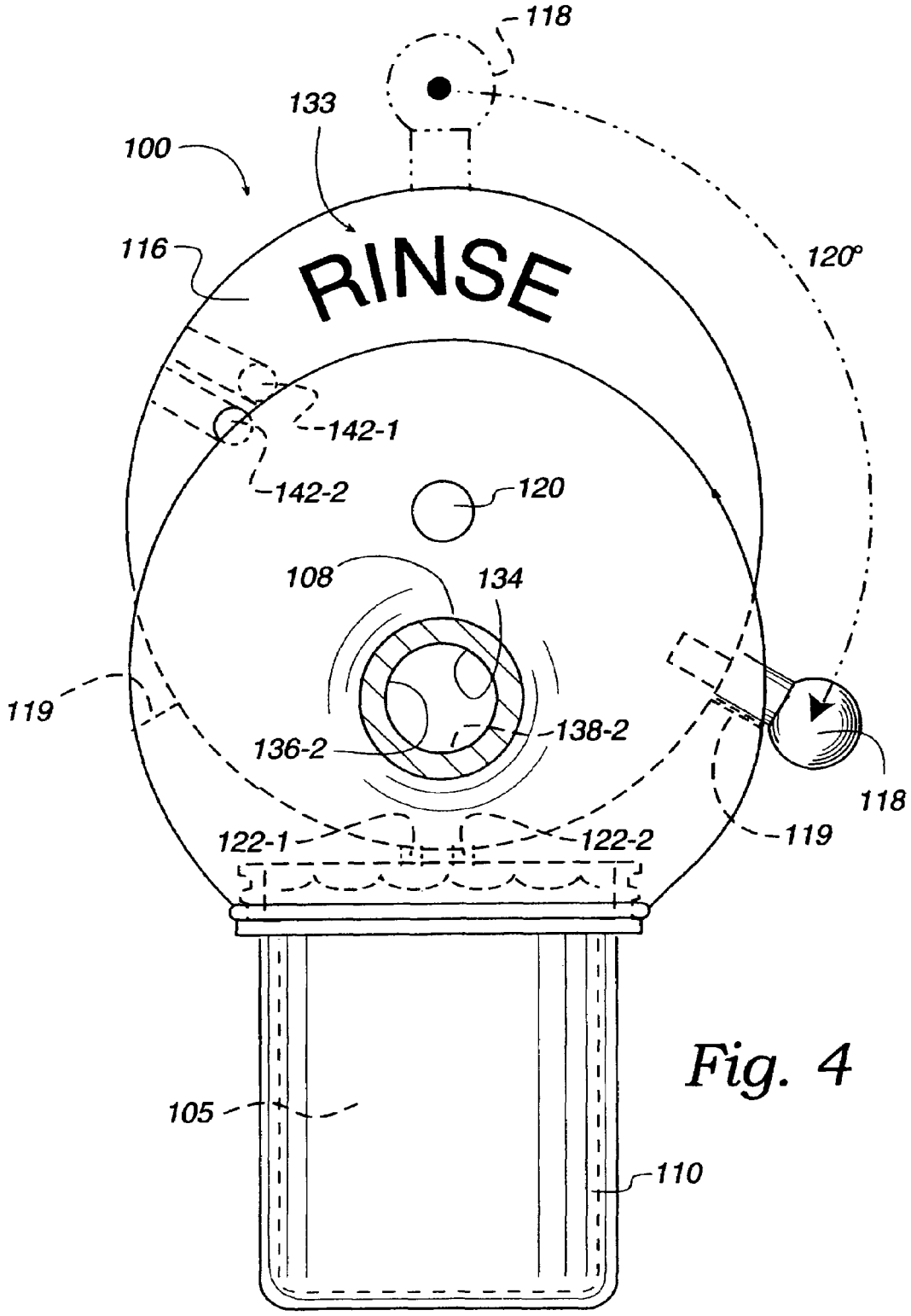
FIG. 4 is a front elevation of the showerhead assembly in rinse position showing the exit pipe in a cutaway view.

Referring to FIG. 3, lines 4-4 indicate a partial vertical section of FIG. 4, the pin 120 extends through a hole 130, in an outer bracket 114-1, through a hole 132 at the middle of the disk 116 and through a hole 134 in the opposite outer bracket 114-2. Water flows into the inflow pipe 104 and then into the controller assembly 100 where it mixes with solutes 105 (such as body lotion, shampoo, liquid soap or moisturizers) in the reservoir 110. The lower controls, 101 (dashed lines of FIG. 1), also control the temperature of the water and solutes or may direct only water 103 for flushing to clean the inside of the control assembly 100 or for rinsing off after showering. By turning the disk 116 the apertures in the disk will line-up with the integral apertures of the disk of the control assembly, allowing water and solutes to flow in specified ways including being turned off.

Referring to FIG. 4, the disk 116 is shown in a position of alignment whereas the insides of inflow pipe 136-1 and outflow pipe 136-2 line up, thus allowing water and/or solutes to pass directly through the controller assembly. In this position the "RINSE" imprint is visible to the shower user. A sectional view of the inflow pipe 136-1, of this drawing is covered by outflow pipe 136-2 and is therefore not in view due to the dose alignment with the inflow pipe 136-2 and does not show in FIG. 4.

Figure 5:
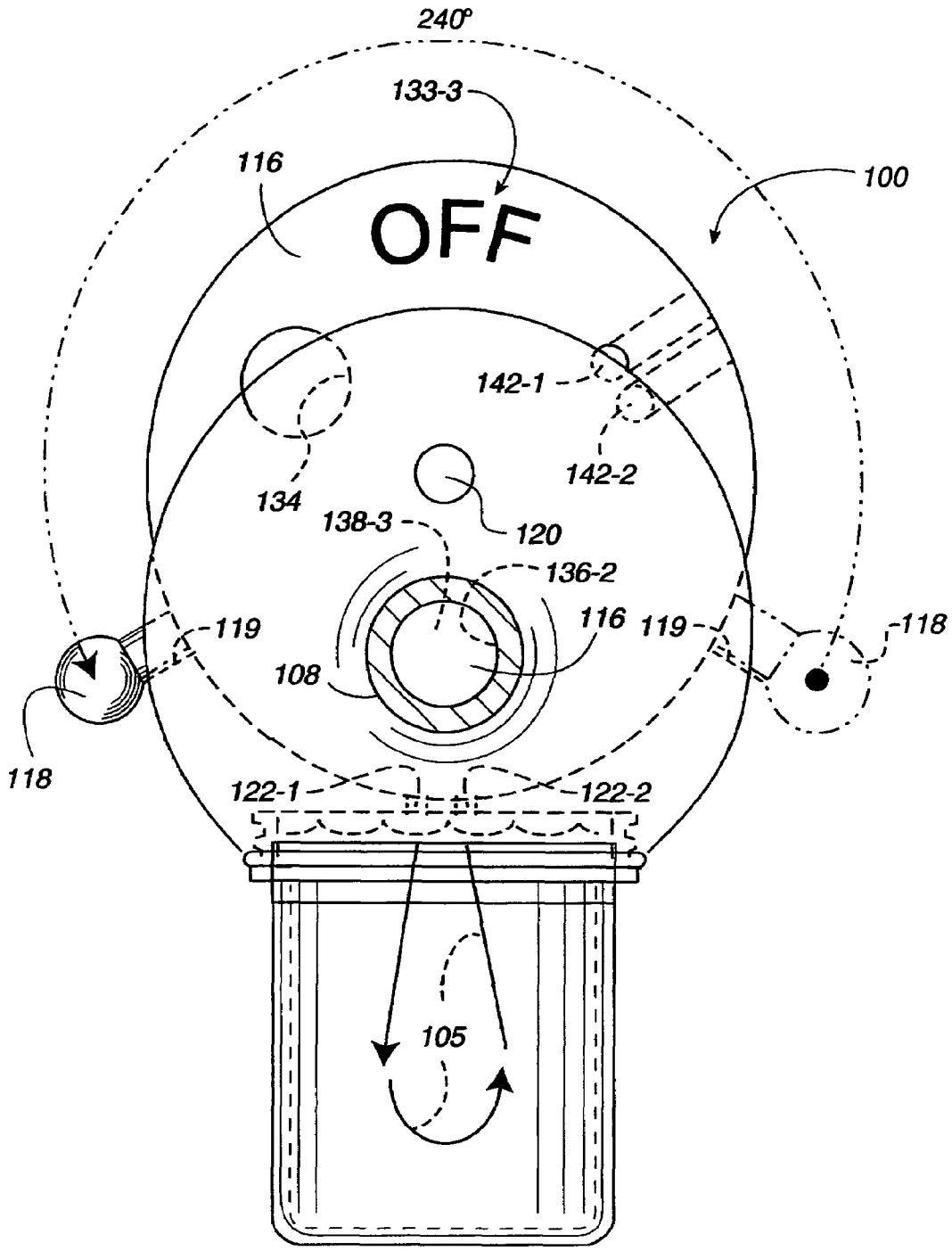
FIG. 5 is a front elevation of the combination showerhead in off position, also showing the exit pipe in a cutaway view.

Referring to FIG. 5, the disk 116 is shown rotated to a position whereas the inflow pipe 136-1 and outflow pipe 136-2 are urged against parallel opposite surfaces of the disk 116 to prevent water and/or solutes from passing directly through the controller assembly. This stops the movement of liquid while at the same time the "OFF" imprint at the top of disk 116 becomes visible to the shower user. This serves as the upper shutoff for liquids of the controller assembly.

Figure 6:
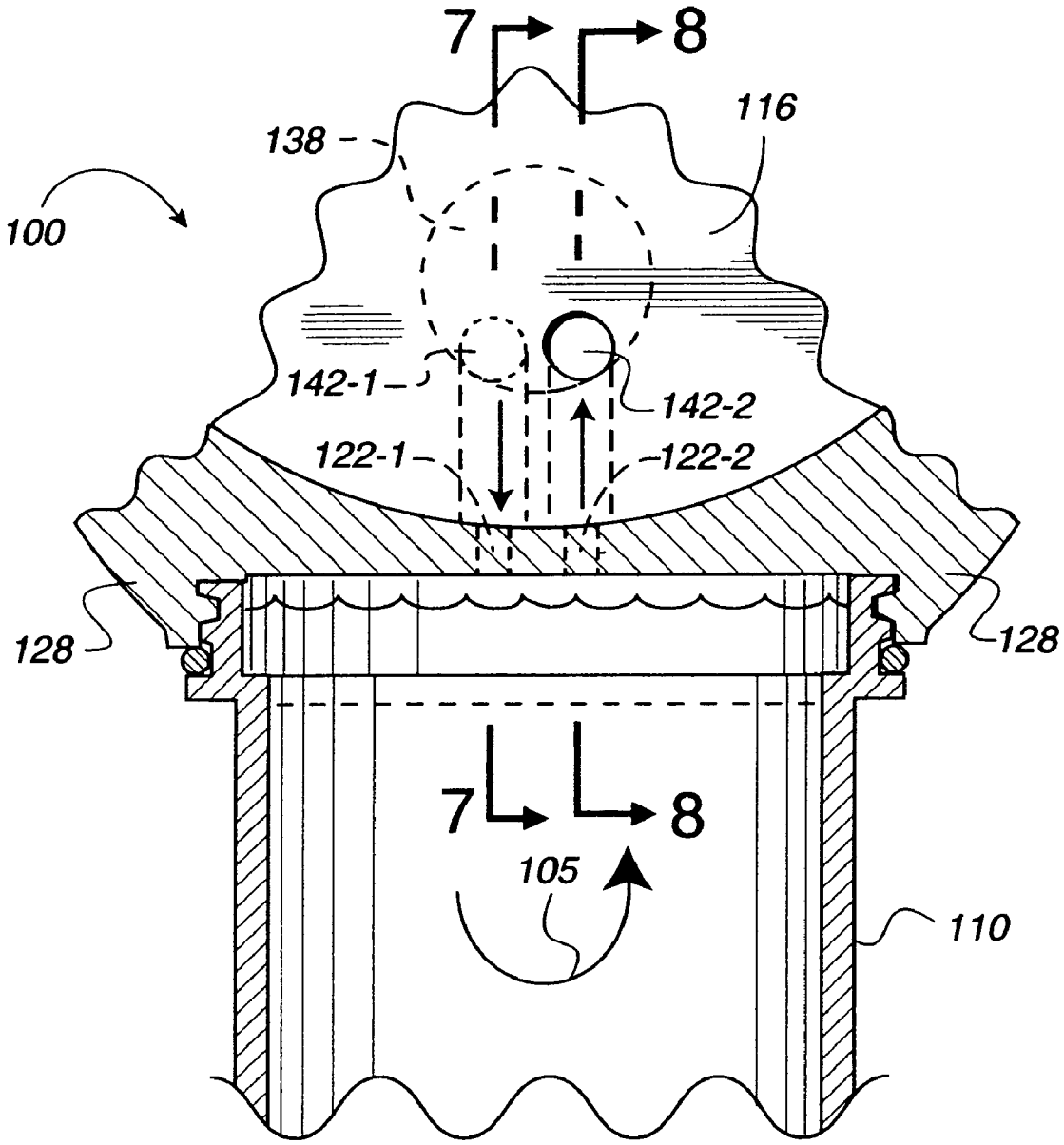
FIG. 6 is a cutaway view of a vertical section depicting water and solute passageways in the showerhead assembly.
Figure 7:
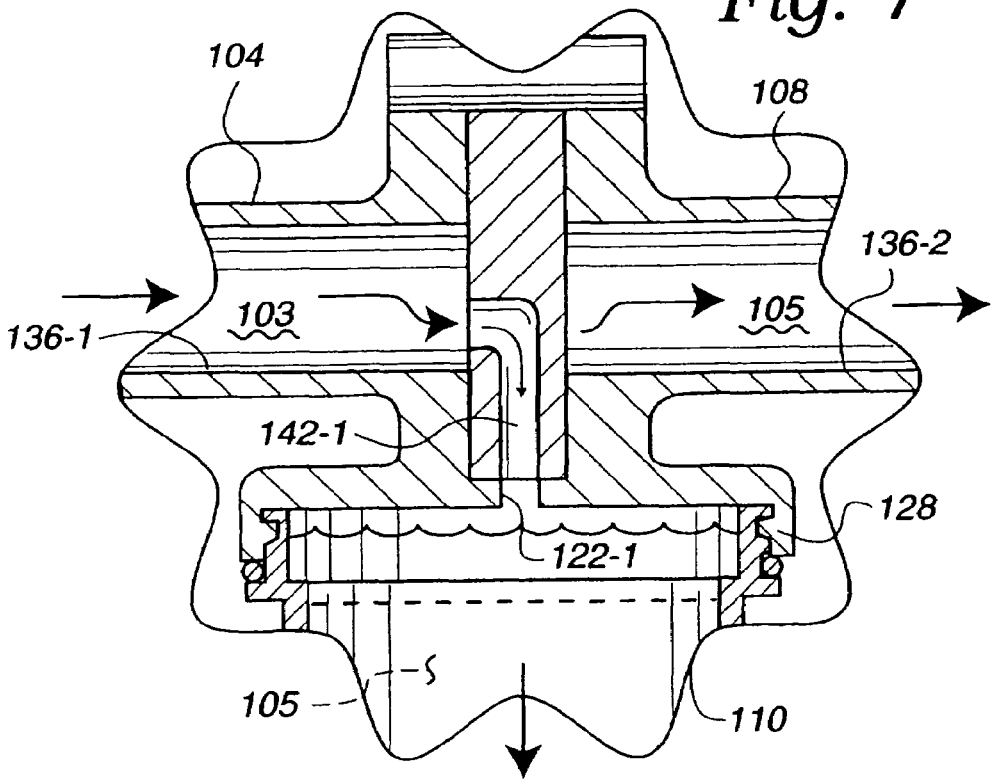
FIG. 7 is a cutaway of a vertical section along the line 7-7 of FIG. 6 depicting water-solute passageways in the showerhead assembly.
Figure 8:
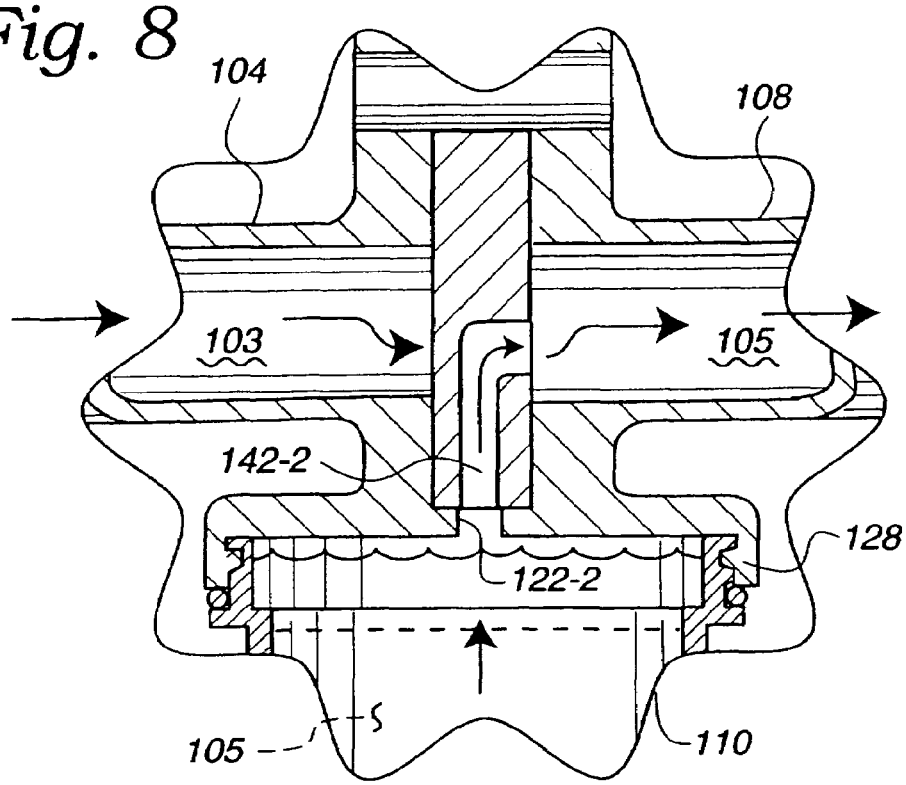
FIG. 8 is a cutaway of a vertical section of water-solute passageways alone the line 8-8 of FIG. six in the showerhead assembly.
Figure 9:
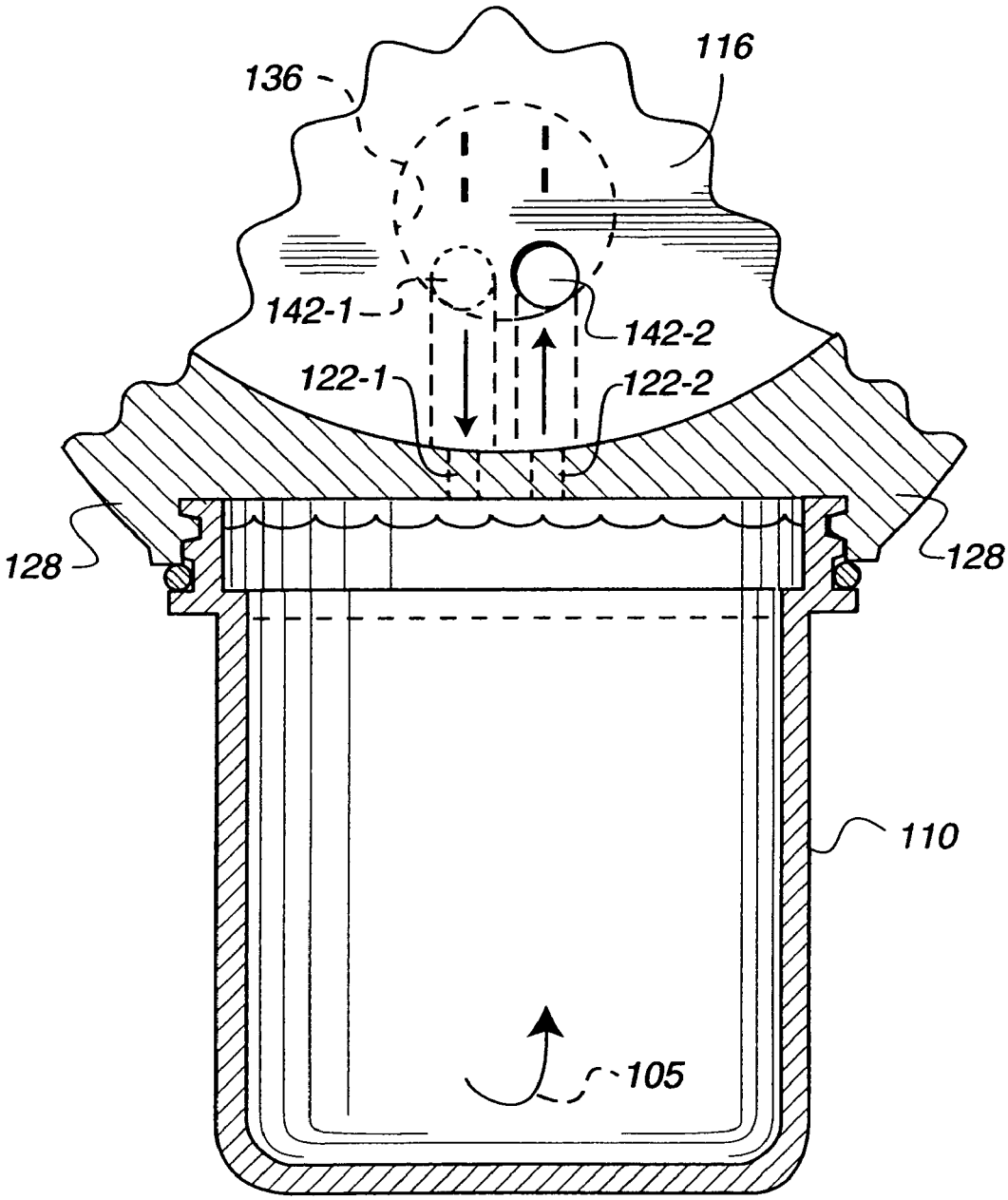
FIG. 9 is a cutaway of a vertical section along the line 7-7 of FIG. 6 depicting water-solute passageways in the showerhead assembly further including pipes attached to the showerhead assembly and extending nearly to the bottom of the reservoir for improved mixing of solute and water.

Referring to FIG. 6, the disk 116 is shown rotated to a position whereas the inflow pipe 136-1 and outflow pipe 136-2 form seals against parallel opposite surfaces of the disk 116. This stops the movement of liquid while at the same time the "OFF" imprint at the top of disk 116 becomes visible to the shower user. This, as previously mentioned, serves to stop liquids from moving through the controller assembly. Line 7-7 delineates the sectioned off FIG. 7. Line 8-8 delineates the sectioned off FIG. 8.

Referring again to FIG. 6, the disk 116 is shown rotated to a position whereas the inflow pipe 136-1 and outflow pipe 136-2 form seals against parallel opposite surfaces of the disk 116 to prevent water and/or solutes from passing horizontally through the controller assembly. This stops the movement of liquid while at the same time the "OFF" imprint at the top of disk 116 becomes visible to the shower user. This, as previously mentioned, serves to stop liquids from moving through the controller assembly. Line 7-7 delineates the sectioned off FIG. 7. Line 8-8 delineates the sectioned off FIG. 8.

REFERENCE NUMBERS ASSIGNED TO PARTS

100 mixing controller assembly
101 lower controls
102 ninety degree pipe inflow connector
103 water inflow arrow
104 water inflow integral with the controller assembly
105 horizontal water or mixture outflow arrow
106 vertical inflow water pipe
108 bent down at end outlet pipe carrying water or water-lotion flow
110 reservoir
111 Shower wall
112 showerhead
114-1 first bracket (shower wall side)
114-2 second bracket (showerhead side)
116 adjustment disk
118 hand knob (adjustment)
119 adjustment stops (two) one on each side
120 pin
122-1 first hole (directs water into the reservoir)
122-2 second, hole (directs water out of the reservoir)
123-1 hole (in bracket 114-1 that pin 120 goes through)
123-2 hole (centered in the adjustment disk 116 that pin 120 goes through)
123-3 hole (in extension 114-2 that pin 120 goes through)
124
126
128 reservoir cap (integral with the controller assembly)
130 hole through bracket 114-1
132 hole through disk 116
133-1 "lotion" (imprinted upon disk 116)
133-2 "rinse" (imprinted upon disk 116)
133-3 "off" (imprinted upon disk 116)
134 hole through bracket 114-2
136-1 inside of inflow pipe
136-2 inside of out flow pipe
142-1 water aperture (inflow to reservoir thru disk 116)
142-2 water aperture (outflow from reservoir thru disk 116)
144-1 inflow to bottom of reservoir and out of pipe 108
144-2 outflow to pipe 108

What is claimed is:

1. A controller assembly (100) that is attachable by suitable means to a shower wall (107) for controlling flow of solute and water to an attached showerhead (126), the controller assembly comprising: an inlet (104) configured to attach to a water supply pipe (106), an outlet (108) configured to attach to the showerhead (126), a reservoir (110) attached by threaded surfaces (128) to the controller assembly wherein solute (105) in the reservoir mixes with water (103) pressing through the controller assembly forming a mixture (105) during operation of the controller assembly to which the reservoir is affixed, a manually rotatable adjustment disk (116) having an axial means (120) disposed within a hole (130) of a first mounting bracket (114-1), through another hole (132) at the center of the adjustment disk, (116) and continuing through yet another hole (134) of a second mounting bracket (14-2), whereby the axial means (120) pivotably holds both mounting brackets and the adjustment disk in line, with the adjustment disk (116) being able to be turned manually in a clockwise or counterclockwise motion perpendicular to the water supply pipe (104) and outlet pipe (108), the adjustment disk being sandwiched between the two integral mounting brackets, has a plurality of integral bypass apertures, that are selectively positionable relative to the inlet and outlet, to do any one of the following, when being turned by hand, direct said water (103) from the inlet (104) into the reservoir to the outlet (108) and to the showerhead (126), direct water to flow directly from the inlet (104) to the outlet (108) and not into the reservoir, and block the water from flowing from the inlet to the reservoir and to the outlet, the adjustment disk, when rotated manually, will also selectively decrease or increase the flow of the water or water-solute mixture (105) to finely control flows.

2. The controller assembly (100) of claim 1 further comprising means to adjust for different flows of water and mixtures for showering by showing different imprinted positions upon the adjustment disk that indicates a water-solute mixture going to the showerhead marked as lotion, rinse water to the showerhead, marked as rinse or no liquid to the showerhead marked as off for controlling water flow (103) to the disk (116) and water-lotion mixture (105) to the showerhead (102), the disk having a plurality of integral bypass apertures with at least two of the apertures (142-1, 142-2) capable of being manually aligned with the apertures (122-1) and 122-2 respectively which directs water (103) to the reservoir and the other aperture being adjustable for directing mixture (105) to the showerhead, the lower ends of both said apertures (142-1, 142-2) when aligned with apertures (122-1, 122-2), connecting to the reservoir, tubes (144-1, 144-2) of different lengths, suitably fastened at their upper ends to the integral reservoir cap mixing the water and solute (105) at the bottom of the reservoir before being directed to the showerhead.

3. The controller assembly (100) of claim 1 whereby the adjustment disk, (116) when rotated to its limits, clockwise to one stop and then all the way counterclockwise to an other stop, or any places in between the two extreme ends of the adjustment prevents the disk (116) from exceeding a predetermined rotation, a grab-bar (118), is suitably attached to the outside perimeter of the adjustment disk (116), having a solid sphere of suitable material contiguous with the bar that connects the disk with the sphere on the grab-bar for easy manual adjustment.

* * * * *

UNITED STATES PATENT AND TRADEMARK OFFICE

CERTIFICATE OF CORRECTION

PATENT NO. : 7,661,607 B1
APPLICATION NO. : 11/900621
DATED : February 16, 2010
INVENTOR(S) : Gladys P. Bowden It is certified that error appears in the above-identified patent and that said Letters Patent is hereby corrected as shown below:

Column 4, Lines 20-25, between 106 and 108, add -- 107 shower wall --

Column 4, Line 27, delete "111 shower wall"

Column 4, Line 28, delete "112 showerhead"

Column 4, Line 41, delete "124"

Column 4, Line 42, after 126 add -- showerhead --

Signed and Sealed this

Eighteenth Day of May, 2010

David J. Kappos

David J. Kappos
*Director of the United States Patent and Trademark Office*